US011459776B2

(12) United States Patent
Wang

(10) Patent No.: US 11,459,776 B2
(45) Date of Patent: Oct. 4, 2022

(54) FLOOR MAT FOR LAYING ON THE GROUND AND FLOOR USING THE SAME

(71) Applicant: ZHEJIANG RUNYANG NEW MATERIALS TECHNOLOGY CO., LTD., Huzhou (CN)

(72) Inventor: Guanghai Wang, Huzhou (CN)

(73) Assignee: ZHEJIANG RUNYANG NEW MATERIALS TECHNOLOGY CO., LTD., Zhejiang Province (CN)

( * ) Notice: Subject to any disclaimer, the term of this patent is extended or adjusted under 35 U.S.C. 154(b) by 0 days.

(21) Appl. No.: 17/270,476

(22) PCT Filed: Nov. 26, 2019

(86) PCT No.: PCT/CN2019/120883
§ 371 (c)(1),
(2) Date: Feb. 23, 2021

(87) PCT Pub. No.: WO2021/068371
PCT Pub. Date: Apr. 15, 2021

(65) Prior Publication Data

US 2022/0034101 A1 Feb. 3, 2022

(30) Foreign Application Priority Data

Oct. 8, 2019 (CN) ..... 201910950034.X

(51) Int. Cl.
*E04F 15/20* (2006.01)
*G10K 11/00* (2006.01)
*E04B 1/86* (2006.01)

(52) U.S. Cl.
CPC ..... *E04F 15/203* (2013.01); *E04B 1/86* (2013.01); *E04F 15/20* (2013.01); *G10K 11/002* (2013.01); *E04F 2290/043* (2013.01)

(58) Field of Classification Search
CPC .. E04B 1/86; E04F 15/02; E04F 15/20; E04F 15/203; E04F 2290/043; G10K 11/002; A47G 27/0212
See application file for complete search history.

(56) References Cited

U.S. PATENT DOCUMENTS 4,945,697 A * 8/1990 Ott ..... E04F 15/02 52/480
5,125,475 A * 6/1992 Ducharme ..... E04B 1/86 181/294

(Continued)

FOREIGN PATENT DOCUMENTS

CN 2725415 Y 9/2005
CN 206815571 U 12/2017

(Continued)

*Primary Examiner* — Jessie T Fonseca
(74) *Attorney, Agent, or Firm* — Olive Law Group, PLLC

(57) ABSTRACT

The disclosure belongs to the technical field of soundproof flooring, and discloses a floor mat and a floor. The floor mat includes a floor mat body made of foamed material. At least one surface of the floor mat body is provided with a number of soundproof units with the same area. Each of the soundproof unit has at least one soundproof structure. At least one of the numbers, shapes and distribution positions of the soundproof structures are different. The floor mat of the present disclosure can play a sound absorption effect; at the same time, a plurality of chaotic sounds are dispersed and mutually offset, which effectively isolates most of the sounds and has a good soundproof effect.

9 Claims, 6 Drawing Sheets

(56) References Cited

U.S. PATENT DOCUMENTS

| | | | | |
|---|---|---|---|---|
| 2007/0056237 | A1* | 3/2007 | Kang | E04F 15/22 52/403.1 |
| 2008/0236097 | A1 | 10/2008 | Tinianov | |

FOREIGN PATENT DOCUMENTS

| | | | |
|---|---|---|---|
| CN | 207194390 | U | 4/2018 |
| KR | 102370085 | B1 * | 3/2002 |
| KR | 200393477 | Y1 | 8/2005 |
| KR | 100762925 | B1 * | 10/2007 |
| KR | 102108797 | B1 * | 5/2020 |

* cited by examiner

FLOOR MAT FOR LAYING ON THE GROUND AND FLOOR USING THE SAME

CROSS REFERENCE TO RELATED APPLICATIONS

This is a national phase application of PCT Application No. PCT/CN2019/120883, filed Nov. 26, 2019, which claims priority to Chinese Patent Application No. 20190950034X, filed Oct. 8, 2019, the contents of which are incorporated herein by reference in their entireties.

TECHNICAL FIELD

The disclosure relates to the technical field of soundproof flooring, in particular to a floor mat and a floor.

BACKGROUND

Noise in buildings is classified into airborne sound and impact sound according to the way it is generated and the characteristics of its propagation. Airborne sound is caused by the vibration of the sound source to cause the vibration of the surrounding air particles, and spread to the outside in the form of longitudinal waves combining rarefaction and density. For example, the sound heard by a person when walking is airborne sound. Impact sound is the noise generated by the direct contact between the vibrating body of the sound source and the building structure, or the impact between solids, and the vibration energy is directly transmitted to the building structure. For example, when people walking or furniture moving, the noise heard by those under the floor is the impact sound.

Before the floor is laid on the ground, it is necessary to lay a layer of floor mats with a certain thickness on the ground first. The floor mats are usually made of foamed materials. The floor mat can achieve the effects of moisture proof, mildew proof, and improved foot feel. Traditional floor mats are usually designed to improve foot feel, and the sound is evenly transmitted downwards after penetrating the floor mats. Therefore, the traditional floor mats have a poor blocking effect on percussive sound. In addition, the traditional floor mats are provided with regular patterns or shapes after being processed by the roller, which meets the needs of beautiful appearance and uniform foot feel. Objectively, some shapes have a certain sound insulation function, but they are not specially designed for sound insulation, and the soundproof effect is poor.

SUMMARY

One object of the present disclosure is to provide a floor mat with good soundproof effect.

To this end, the present disclosure adopts the following technical solutions: a floor mat includes a floor mat body made of foamed material, a number of soundproof units (1) with same areas are provided on at least one surface of the floor mat body, and each of the soundproof unit has at least one soundproof structure, the soundproof structures in adjacent soundproof units is different in at least one of the numbers, the shapes and the distribution positions.

In a preferred embodiment, the soundproof structure is a press hole, and the press hole is a blind hole or a through hole.

In a preferred embodiment, at least one of the hole diameter of the press hole, the depth of the press hole, and the cross-sectional shape of the press hole in the depth direction are different.

In a preferred embodiment, the press hole is a blind hole, and the bottom surface of the blind hole is provided with a scattering block with a plurality of scattering surfaces protruding from the bottom surface of the blind hole.

In a preferred embodiment, the plurality of scattering surfaces of the scattering blocks form block portions at their intersections, and one of all block portions of each scattering block that is farthest from the center layer of the floor mat constitutes a support portion for interacting with the ground. The distances between the support portions of two adjacent scattering blocks and the center layer of the floor mat are equal, and the distance from the support portions to the bottom surface of the blind hole is not greater than the depth of the blind hole.

In a preferred embodiment, the soundproof structure is a scattering block with a plurality of scattering surfaces protruding to one side of the floor mat body, and the plurality of scattering surfaces of each scattering block form block portions at their intersections. Among all the block portions, the one farthest from the center layer of the floor mat constitutes a support portion for interacting with the ground, and the distance between the support portions of two adjacent scattering blocks and the center layer of the floor mat are equal.

In a preferred embodiment, the support portion is a linear structure parallel to the center layer of the floor mat.

In a preferred embodiment, the shape of the soundproof unit is rectangular, and the area is 1 $cm^2$ to 100 $cm^2$.

In a preferred embodiment, the foamed material is one or more selected from a group consisting of IXPE, EVA, XPE and foamed polyethylene.

Another object of the present disclosure is to provide a floor with good soundproof effect.

To this end, the present disclosure adopts the following technical solutions: a floor includes a floor layer and a floor mat layer with the same plane sizes, the floor mat layer is bonded to the back of the floor layer, and the floor mat layer is formed by the floor mat according to any one as above mentioned, and the thickness of the floor layer is 1-18 times the thickness of the floor mat.

Yet another object of the present disclosure is to provide a method for producing a floor mat, which has better soundproof effects and high economic value.

To this end, the present disclosure adopts the following technical solution: a method for producing a floor mat includes the following steps:

preparing rollers; wherein a pair of rollers is provided, an outer peripheral surface of at least one of the rollers has several engraving units with the same area, each of the engraving unit has at least one engraving structure, and the engraving structures in the adjacent engraving units are different in at least one of the number, the shape and the distribution position;

foaming foamed material, and the foam material being foamed to form a soft film layer;

extrusion forming by using the roller; wherein the soft film layer is passed between a pair of the rollers, and the roller presses the soft film layer to form a floor mat.

In a preferred embodiment, the engraving structure is a column protruding from the outer peripheral surface of the roller.

In a preferred embodiment, at least one of the diameter of the column, the height of the column, and the cross-sectional shape of the column in the height direction is different.

In a preferred embodiment, the outer end surface of the column is engraved with an extrusion block that protrudes from the end surface of the column and has a plurality of extrusion surfaces, or a pit that is recessed in the end surface of the column and has a plurality of extrusion surfaces.

In a preferred embodiment, the engraving structure is a pit that is recessed into the roller and has a plurality of extrusion surfaces.

In a preferred embodiment, the engraving structure is formed by laser engraving.

In a preferred embodiment, the shape of the engraving unit is rectangular, with the area of 1 $cm^2$ to 100 $cm^2$.

In a preferred embodiment, the foamed material is one or more selected from a group consisting of IXPE, EVA, XPE and foamed polyethylene.

The beneficial effects of the present disclosure are that: the present disclosure provides a floor mat and a floor. The floor mat includes a floor mat body made of foamed material, at least one surface of the floor mat body is formed with a number of soundproof units with a same area, and each of the soundproof units has at least one soundproof structure, and the soundproof structures in adjacent soundproof units are different in at least one of a number, a shape and a distribution position. When sound penetrates the surface of the irregularly distributed soundproof structure, it causes the air in the soundproof structure to vibrate. Due to frictional resistance, viscous resistance of the air and heat conduction, a considerable part of the sound energy is converted into heat energy, thereby acting as a sound absorption. At the same time, because the sound is usually propagated in a straight direction, when the soundproof structures are irregularly distributed, part of the unabsorbed sound can be irregularly reflected and propagated in different directions, scattered to form multiple chaotic sounds and can mutually offset, such that most sounds can be effectively isolated, and high-frequency and low-frequency noise can be effectively blocked, and the soundproof effect is good. In addition, the structure improvement of the floor mat of the present disclosure only needs to change the roller structure of the floor mat, the production process is simple, the production time and the production cost are not increased, and the realization is strong.

DETAILED DESCRIPTION OF EMBODIMENTS

The technical solutions of the present disclosure will be further described below in combination with the accompanying drawings and specific embodiments.

The First Embodiment

Figure 1:
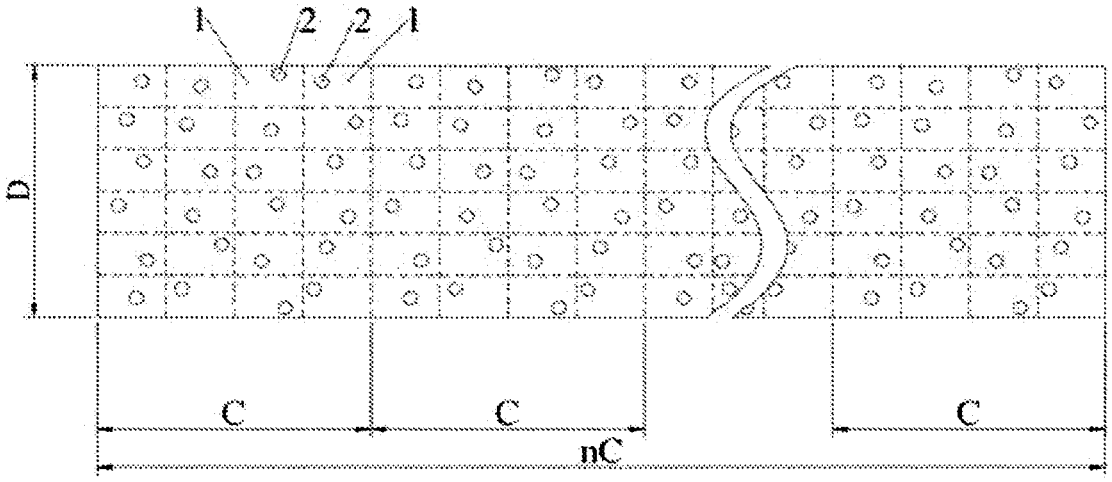
FIG. 1 is a schematic structural diagram of a floor mat provided by the present disclosure.

The embodiment provides a floor mat. As shown in FIG. 1, the floor mat may include a floor mat body made of foamed material. On at least one surface of the floor mat body, a plurality of soundproof units 1 with the same area may be provided. The soundproof unit 1 may have at least one soundproof structure 2, and the soundproof structures 2 in adjacent soundproof units 1 may be different in at least one of the number, the shape and the distribution position.

When sound penetrates the surface of the irregularly distributed soundproof structure 2, it causes the air vibration in the soundproof structure. Due to frictional resistance, viscous resistance of the air and heat conduction, a considerable part of the sound energy is converted into heat energy, thereby acting as a sound absorption. At the same time, because the sound is usually propagated in a straight direction, when the soundproof structures 2 are irregularly distributed, part of the unabsorbed sound can be irregularly reflected and propagated in different directions, scattered to form multiple chaotic sounds and can mutually offset, such that most sounds can be effectively isolated, and the soundproof effect is good.

Since the traditional floor mat is not provided with the soundproof structure 2, the surface of the roller is a smooth arc surface to ensure that the upper and lower surfaces of the formed floor mat body are flat. However, the floor mat body provided in this embodiment may be provided with a soundproof structure 2. During production, it may be only necessary to provide a carved or recessed structure corresponding to the soundproof structure 2 on the surface of the roller. The carved or recessed structure can be realized by laser engraving. The soft film layer after foaming may be squeezed by a pair of rollers to form a corresponding soundproof structure 2. The floor mat body can be formed by the roller rotating one or more laps. The circumference of the roller may be set as C and the length in the axial direction as D, then the width of the mat body may be D and the length may be n*C (referring to FIG. 1, where n may be the lap number of rotations of the roller). The floor mat body formed by the rotation of the roller may include several soundproof units 1 with the same area, and at least one of the number, shape and distribution position of the soundproof structures 2 in adjacent soundproof units 1 may be different. The improvement to the structure of the floor mat in the embodiment only needs to change the structure of the roller producing the floor mat. The production process is simple, hardly increases the production time and production cost. It is highly achievable, and is particularly effective in reducing impact sound obvious. Compared with the prior art, traditional floor mats are laid in consideration of shock absorption and improved foot feel. Even if the floor mat has an embossed structure, the regular embossed structure is designed for aesthetics and ease of bonding with the floor. In terms of sound insulation, the existing technique only considers the noise heard by people who use this layer of the floor, that is, the air sound transmitted to ones when people walk on the floor is taken into account, and does not further consider reducing the sound penetrating the floor mat. Therefore, the floor mat provided by the present disclosure is a breakthrough improvement for those skilled in the art, with almost no increase in cost, but with great commercial value. It is believed that the floor mat will be extremely popular in the market and the market acceptance will be high.

It should be particularly pointed out that the soundproof units 1 referred to in the embodiment are not actually a number of physical parts divided from the floor mat body, but are virtual areas logically divided, probably without obvious boundary. The soundproof structure 2 may be a solid structure. In order to facilitate the understanding of this embodiment, adjacent soundproof units 1 may be marked in the form of dashed lines in the figures.

The shape of the soundproof unit 1 may be rectangular, with an area of 1 $cm^2$~100 $cm^2$. In terms of soundproof effect, if the area of the soundproof unit 1 is too large, the number of soundproof structures 2 will be smaller, resulting in that the sound disturbance effect will be small, and the soundproof effect will be poor. If the soundproof unit 1 is too small, even differences exist between the adjacent soundproof units 1, the overall difference may be not obvious, and the floor mat body becomes more uniform overall. In terms of manufacturing feasibility, since the roller needs to form a plurality of soundproof units 1 for one rotation, when the area of the soundproof unit 1 is too small, the engraved or recessed structures corresponding to the soundproof structure 2 provided on the roller may be smaller and have a larger number, causing uneasy manufacturing. When the area of the soundproof unit 1 is too large, the number of carved or recessed structures corresponding to the soundproof structure 2 provided on the roller may be small, and the number of soundproof units 1 finally produced may be small, and the soundproof effect may be weakened. After consideration, when the area of the soundproof unit 1 is between 1 $cm^2$ and 100 $cm^2$, a better soundproof effect can be achieved. Specifically, the area of the soundproof unit 1 may be 1 $cm^2$, 2 $cm^2$, 4 $cm^2$, 9 $cm^2$, 10 $cm^2$, 16 $cm^2$, 20 $cm^2$, 25 $cm^2$, 36 $cm^2$, 40 $cm^2$, 49 $cm^2$, 64 $cm^2$, 70 $cm^2$, 80 $cm^2$, 81 $cm^2$, 100 $cm^2$, etc.

The soundproof structure 2 may be a press hole, and this kind of press hole may be a blind hole or a through hole. When the press hole is a through hole, it causes air vibration in the through hole. Due to frictional resistance, viscous resistance of the air and heat conduction, a considerable part of the sound energy is converted into heat energy, thereby acting as a sound absorption. At the same time, the sound also contacts the inner wall of the through hole, and the inner wall of the through hole has a disturbing effect on the sound, which makes the sound spread out of order and reduces a certain amount of energy. When the press hole is a blind hole, the inner wall and bottom surface of the blind hole have a sound disturbing effect, most of the energy may be consumed under the interference of the air vibration in the blind hole, achieving the effect of sound absorption and sound insulation.

Figure 2:
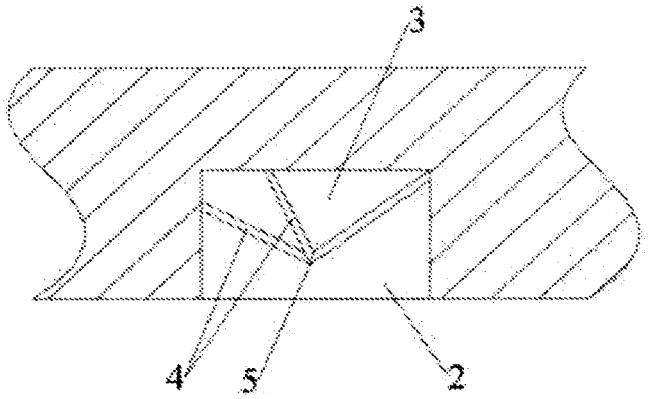
FIG. 2 is a cross-sectional view showing the soundproof structure provided by the first embodiment according to the present disclosure.

As shown in FIG. 2, when the press hole is a blind hole, the bottom surface of the blind hole may be provided with a scattering block 3 that has a plurality of the scattering surfaces and protrudes from the bottom surface of the blind hole. The number of scattering blocks 3 in each blind hole may be at least one. Sound entering the blind hole will be scattered many times, digested in the blind hole, and the sound may be absorbed. In order to achieve better soundproof effect with the same thickness of traditional materials, they must be made thicker, which will cause problems such as increased costs, poor foot feel and so on. In the embodiment, when the sound is transmitted into the blind hole, since the scattering block 3 has multiple scattering surfaces, the sound will be disturbed by the scattering surface when it contacts the scattering surfaces. At the same time, since the scattering block 3 has multiple scattering surfaces, the sound energy will dissipate greatly after multiple disturbances between multiple scattering surfaces.

The plurality of the scattering surfaces of the scattering block 3 form block portions 4 at their intersections. Among all the block portions 4 of each scattering block 3, the block portion 4 that is the farthest from the center layer of the floor mat constitutes a support 5 for interacting with the ground. The block portion 4 can provide more planes for disturbing the sound. After the sound is introduced into the press hole, it can be transmitted back and forth between several scattering surfaces and the side of the block portion 4. The more surface the sound contacts, the greater disturbance effect of the sound is received and the larger dissipation of the sound is made. The floor mat will be squeezed and deformed when it is stepped on artificially during use. Because of providing of the block portion 4, the floor mat can contact the ground when stepping down, thereby making the section in a press hole divided into a number of subsections to form a soundproof cavity, the sound circuit may be more complicated, and the sound consumption may be greater. At the same time, the block portion 4 contacts the ground to form a support, which can improve the foot feel. Due to the supporting effect of the block portion 4, the press hole is not easy to cause large deformation, so the opening area of the press hole can be set larger.

The distances between the support portions 5 of two adjacent scattering blocks 3 and the center layer of the floor mat may be equal, and the distance from the support portions 5 to the bottom surface of the blind hole may be not greater than the depth of the blind hole. Due to the different shapes and different distribution positions etc. of the blind holes, the foot feel at different positions will be different. In some places, the foot feel may be soft, and in some places the foot feels may be relatively hard. After long-term use, the floor mat will be aging, which will easily cause the floor mat to be uneven and inclined. In the embodiment, the support portion 5 may be used to support the blind hole, and the distances between the support portions 5 of two adjacent scattering blocks 3 and the center layer of the floor mat may be equal, such that the foot feel of the floor mat may be more even, and the force may be more uniform. Its service life can be increased.

The foaming material may be one or more selected from a group consisting of IXPE, EVA, XPE and foamed polyethylene. Such materials have the functions of sound absorption and noise reduction, shock absorption and buffering, heat insulation, moisture resistance, and corrosion resistance. In the process of forming the floor mat body, the foamed material may be first foamed to form a soft film layer with a certain thickness, and then extruded by a pair of spaced rollers to form a floor mat body with uniform thickness. When passing the roller, the floor mat body can be squeezed and shaped by the rollers distributed up and down, and at the same time, a cooling structure may be provided in the roller configured to cool the floor mat body, such that the floor mat body can maintain the squeezed shape.

The embodiment also provides a floor. The floor may include a floor layer and a floor mat layer with the same plane size. The floor mat layer may be composed of any of the above-mentioned floor mats. The floor mat layer may be bonded to the back of the floor layer. The thickness of the floor layer may be 1-18 times the thickness of the floor mat layer. Since the floor mat can be effectively soundproof, after laying such floor mat, the soundproof effect between the upper and lower floors may be better. The floor mat layer may include one, two or more layers of floor mats. The adjacent floor mats of the floor mat layer may be bonded by a glue layer, the floor layer and the floor mat layer may be also bonded by a glue layer.

The embodiment also provides method for producing a floor mat, which may include the following steps:

preparing rollers; wherein a pair of rollers is provided, an outer peripheral surface of at least one of the rollers has several engraving units with the same area, each of the engraving unit has at least one engraving structure, and the engraving structures in the adjacent engraving units are different in at least one of the number, the shape and the distribution position;

foaming foamed material, and the foam material being foamed to form a soft film layer;

extrusion forming by using the roller; wherein the soft film layer is passed between a pair of the rollers, and the roller presses the soft film layer to form a floor mat.

The production of floor mats through the above steps has the following advantages:

First of all, in terms of manufacturing, since the roller can be used for a long time, it may be only necessary to prepare the roller at the beginning of production, and the design and engraving structure of the roller may be more feasible, with better operability, the cost of the roller increases little. Secondly, this method hardly increases the production time, is highly feasible, and has high economic value. In addition, the floor mat produced by this method has a higher added value due to its irregular soundproof structure. When the sound penetrates the surface of the irregularly distributed soundproof structure, it causes the air in the soundproof structure to vibrate. Due to frictional resistance, viscous resistance of the air and heat conduction, a considerable part of the sound energy is converted into heat energy, thereby acting as a sound absorption. At the same time, because the sound is usually propagated in a straight direction, when the soundproof structures are irregularly distributed, part of the unabsorbed sound can be irregularly reflected and propagated in different directions, scattered to form multiple chaotic sounds and can mutually offset, such that most sounds can be effectively isolated, that is, the floor mat can have good soundproof effect and high use value. At last, the quality of the floor mat formed by roller extrusion may be higher.

It should be particularly pointed out that the engraving units referred to in the embodiment are not actually a number of solid parts divided from the outer peripheral surface of the roller, but are virtual areas logically divided. There may be no obvious boundary between adjacent engraving units. The engraving structure may be a solid structure. In this method, the engraving unit of the roller may correspond to the soundproof unit of the floor mat, and the engraving structure of the roller may correspond to the soundproof structure of the floor mat.

The shape of the engraving unit may be rectangular, with an area of 1 $cm^2$~100 $cm^2$. Since the outer peripheral surface of the roller needs to form several engraving units, in order to ensure the unevenness of the soundproof structure, the soundproof unit should not be too small or too large, and the number of soundproof structures should be moderate. After consideration, when the area of the engraving unit is between 1 $cm^2$ and 100 $cm^2$, a better soundproof effect can be achieved. Specifically, the area of the engraving unit may be 1 $cm^2$, 2 $cm^2$, 4 $cm^2$, 9 $cm^2$, 10 $cm^2$, 16 $cm^2$, 20 $cm^2$, 25 $cm^2$, 36 $cm^2$, 40 $cm^2$, 49 $cm^2$, 64 $cm^2$, 70 $cm^2$, 80 $cm^2$, 81 $cm^2$, 100 $cm^2$, etc.

The engraving structure may be a column protruding from the outer peripheral surface of the roller. As a result, the column can squeeze the soft film layer, so that the formed floor mat has irregular press holes, and the floor mat has an effective soundproof effect.

The difference in shape of the engraving structure in adjacent engraving units may be embodied in: at least one of the diameter of the column, the height of the column, and the cross-sectional shape of the column in the height direction. Thus, the formed floor mat can have irregular press holes.

The outer end surface of the column may be engraved with an extrusion block that protrudes from the end surface of the column and has a plurality of extrusion surfaces, or a pit that is recessed in the end surface of the column and has a plurality of extrusion surfaces. As a result, a scattering block that protrudes from or is recessed in the bottom surface of the press hole, and has the plurality of extrusion surfaces can be formed in the press hole of the floor mat. Wherein, the extrusion surfaces may correspond to the scattering surfaces, and the scattering surfaces can cause the sound to be repeatedly disturbed by the scattered surfaces when the sound is introduced into the press hole, and can reduce the sound energy, improve the soundproof effect of the floor mat.

The engraving structure can also be a pit that is recessed into the roller and has a plurality of extrusion surfaces. Thus, the surface of the floor mat forms a scattering block protruding with a plurality of the scattering surfaces.

The engraved structure may be formed by laser engraving. The engraving structure may be formed on the surface of the roller by means of laser engraving, such that the processing process is simple and convenient, and the feasibility is high.

In this method, the foamed material may be one or more selected from a group consisting of IXPE, EVA, XPE and foamed polyethylene. Such materials have the functions of sound absorption and noise reduction, shock absorption and buffering, heat insulation, moisture resistance, and corrosion resistance. In the process of forming the floor mat body, the foamed material may be first foamed to form a soft film layer with a certain thickness, and then extruded by a pair of spaced rollers to form a floor mat body with uniform thickness. When passing the roller, the floor mat body can be squeezed and shaped by the rollers distributed up and down, and at the same time, a cooling structure may be provided in the roller configured to cool the floor mat body, such that the floor mat body can maintain the squeezed shape.

The Second Embodiment

Figure 3:
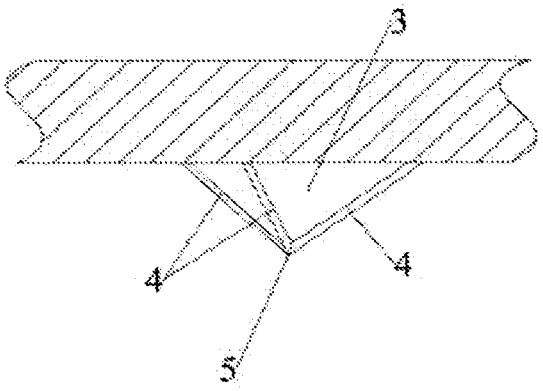
FIG. 3 is a cross-sectional view showing the soundproof structure provided by the second embodiment according to the present disclosure.

As shown in FIG. 3, the difference between this embodiment and the first embodiment is that the soundproof structure 2 in this embodiment may be not provided with blind holes, but scattering block 3 that directly protrudes to the side of the mat body and has a plurality of the scattering surfaces. The plurality of the scattering surfaces of the scattering block 3 may form block portions 4 at their intersections. Among all the block portions 4 of each scattering block 3, the block portion 4 that is the farthest from the center layer of the floor mat constitutes a support 5 for interacting with the ground. The distances between the support portions 5 of two adjacent scattering blocks 3 and the center layer of the floor mat may be equal. When the sound contacts the scattering surfaces and the block portion 4, it may be reflected differently by the irregular surface, and scattered to form multiple chaotic sounds and mutually offset, such that most of the sound can be effectively isolated. The support portion 5 may be used for support, and the distances between the support portions 5 of two adjacent scattering blocks 3 and the center layer of the floor mat may be equal, so that the foot feel of the floor mat may be more even, the force may be more uniform, and the service life may be increased.

The support portion 5 may be a linear structure parallel to the middle layer of the floor mat. When the floor mat is pressed, the support portion 5 may be supported on the ground. Since the support portion 5 is a linear structure, after contact with the ground, the sections on both sides of the support portion 5 can be separated, so that the incoming sound may be separated and the energy of the sound can be weakened. The sound on both sides may be respectively absorbed, and may contact with the scattering surfaces and the scattering block 3 in their respective intervals. After being disturbed by the scattering surfaces and the scattering block 3, the energy of the sound gradually weakens and finally a large amount of sound is absorbed, such that soundproof effect is realized. The linear structures can intersect. As a result, the intersected linear structure may form a network structure. When sound is introduced, the network structure can separate the sound in each grid, and the sound in each grid may be absorbed, respectively, which can achieve a better soundproof effect.

The Third Embodiment

This embodiment is an explanation of the difference in at least one of the number, shape, and distribution position of the soundproof structures 2 in the adjacent soundproof units 1 described in the first embodiment. In the floor mat provided in this embodiment, the number of soundproof structures 2 in adjacent soundproof units 1 may be the same, the shapes may be the same, and the distribution positions may be different. The following are examples describing the structures of the floor mat of this embodiment.

Figure 4:
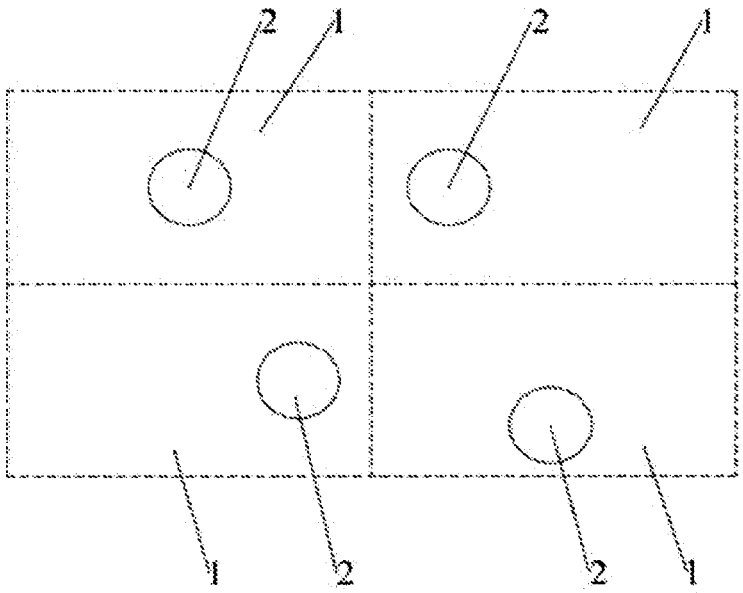
FIG. 4 is a schematic diagram showing the structure of adjacent soundproof units of a floor mat provided by Example 1.

Example 1: As shown in FIG. 4, one soundproof structure 2 may be provided in adjacent soundproof units 1, and all soundproof structures 2 may be blind holes. The blind holes in adjacent soundproof units 1 have different distribution positions in the corresponding soundproof unit 1. Among the four soundproof units 1 arranged in an array shown in FIG. 4, the blind hole in the first soundproof unit 1 may be located at the center of the soundproof unit 1; the blind hole in the second soundproof unit 1 may be located near the left side of the soundproof unit 1; the blind hole in the third soundproof unit 1 may be located near the right side of the soundproof unit 1; and the blind hole in the fourth soundproof unit 1 may be located near the lower side of the soundproof unit 1.

Figure 5:
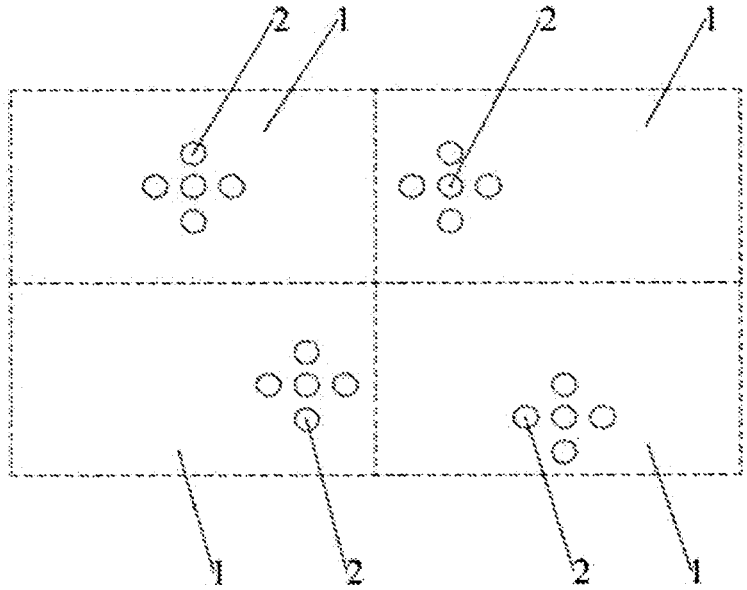
FIG. 5 is a schematic diagram showing the structure of adjacent soundproof units of the floor mat provided by Example 2.

Example 2: As shown in FIG. 5, five soundproof structures 2 may be provided in adjacent soundproof units 1, and all soundproof structures 2 may be blind holes. The blind holes in adjacent soundproof units 1 have different distribution positions in the corresponding soundproof unit 1. Among the four soundproof units 1 arranged in an array shown in FIG. 5, the blind holes in the first soundproof unit 1 may be located at the center of the soundproof unit 1; the blind holes in the second soundproof unit 1 may be located near the left side of the soundproof unit 1; the blind holes in the third soundproof unit 1 may be located near the right side of the soundproof unit 1; and the blind holes in the fourth soundproof unit 1 may be located near the lower side of the soundproof unit 1.

In this embodiment, the soundproof structures 2 in adjacent soundproof units 1 only need to have the same number and shape, and the specific number and specific shape are not limited. For example, the number can be one, two or more; the shape can be: blind hole, square hole, through hole, blind hole with the scattering block 3 in the first embodiment, and scattering block 3 in the second embodiment, and so on.

The Fourth Embodiment

This embodiment is an explanation of the difference in at least one of the number, shape, and distribution position of the soundproof structures 2 in the adjacent soundproof units 1 described in the first embodiment. In the floor mat provided in this embodiment, the number of soundproof structures 2 in adjacent soundproof units 1 may be different, the shapes may be the same, and the distribution positions may be the same. The following is an example describing the structure of the floor mat of this embodiment.

Figure 6:
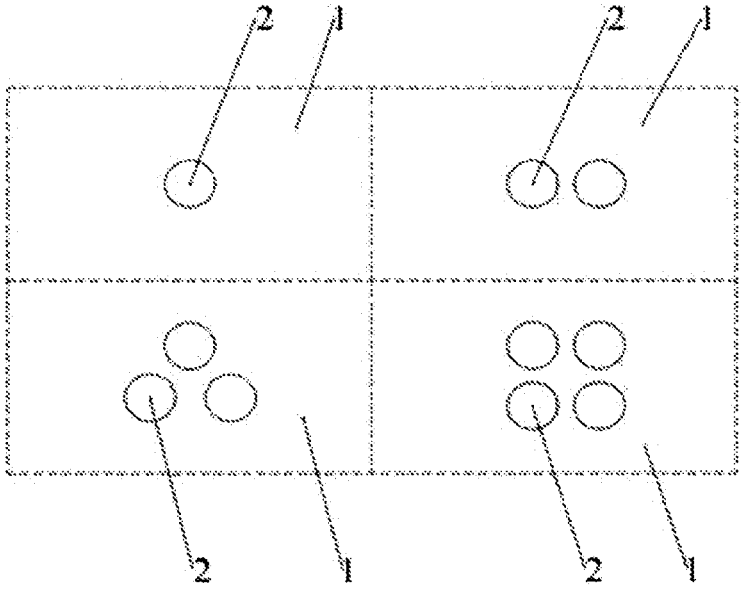
FIG. 6 is a schematic diagram showing the structure of adjacent soundproof units of the floor mat provided by Example 3.

Example 3: As shown in FIG. 6, the soundproof structures 2 may be blind holes, and the soundproof structures 2 in each soundproof unit 1 may be distributed at the center of the soundproof unit 1. Among the four soundproof units 1 arranged in an array shown in FIG. 6, one blind hole may be provided in the first soundproof unit 1; two blind holes may be provided in the first soundproof unit 1; three blind holes may be provided in the first soundproof unit 1; and four blind holes may be provided in the first soundproof unit 1.

In this embodiment, the soundproof structures 2 in adjacent soundproof units 1 only need to have the same shape and distribution position, and the specific shape and specific distribution position are not limited. For example, the shape can be: blind hole, square hole, through hole, blind hole with scattering block 3 in the first embodiment, scattering block 3 in the second embodiment, etc. The distribution position can be that arrangement at the center of the soundproof unit 1, close to the same side, close to the same vertex, etc.

The Fifth Embodiment

This embodiment is an explanation of the difference in at least one of the number, shape, and distribution position of the soundproof structures 2 in the adjacent soundproof units 1 described in the first embodiment. In the floor mat provided in this embodiment, the number of soundproof structures 2 in adjacent soundproof units 1 may be the same, the shapes may be different, and the distribution positions may be the same. The shape of the press hole may be different in at least one of the hole diameter of the press hole, the depth of the press hole, and the cross-sectional shape of the press hole in the depth direction. From the cross-sectional shape of the press hole in the depth direction, the press hole can be a round hole, a square hole, etc.; from the depth of the press hole, the press hole can be a through hole or a blind hole; from the diameter of the press hole, the press hole can be a big hole or a small hole. When sound propagates to the floor mat, it causes air vibration in the press holes. Due to the frictional resistance, the viscous resistance of the air and the heat conduction effect, a considerable part of the sound energy may be converted into heat energy, which plays a sound absorption effect. At the same time, when the sound contacts the bottom surface and inner wall of the press hole with different shapes, it can disperse and form multiple chaotic sounds and mutually offset, such that most of the sounds can be effectively isolated, and a good soundproof effect will be realized. The following are examples describing the structure of the floor mat of this embodiment.

Figure 7:
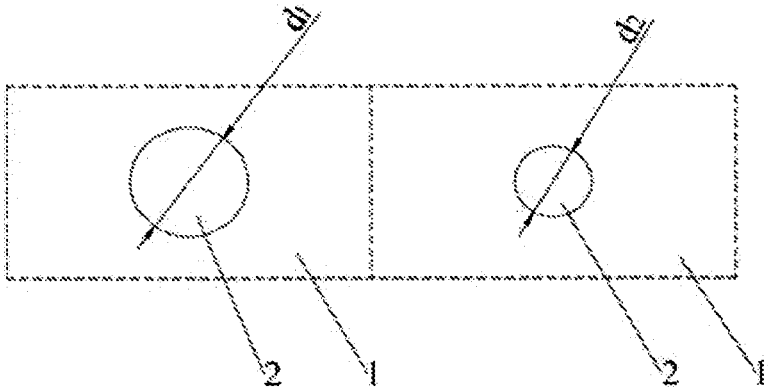
FIG. 7 is a schematic diagram showing the structure of adjacent soundproof units of the floor mat provided by Example 4.

Example 4: In this example, the diameter of the press holes may be different. As shown in FIG. 7, one soundproof structure 2 in adjacent soundproof units 1 may be arrangement at the center of soundproof unit 1. The soundproof structures 2 in adjacent soundproof units 1 may be all blind holes. The hole diameter of the blind hole in the unit 1 may be $d_1$, the depth of the press hole in the second soundproof unit 1 may be $d_2$, and $d_1 \neq d_2$.

Figure 8:
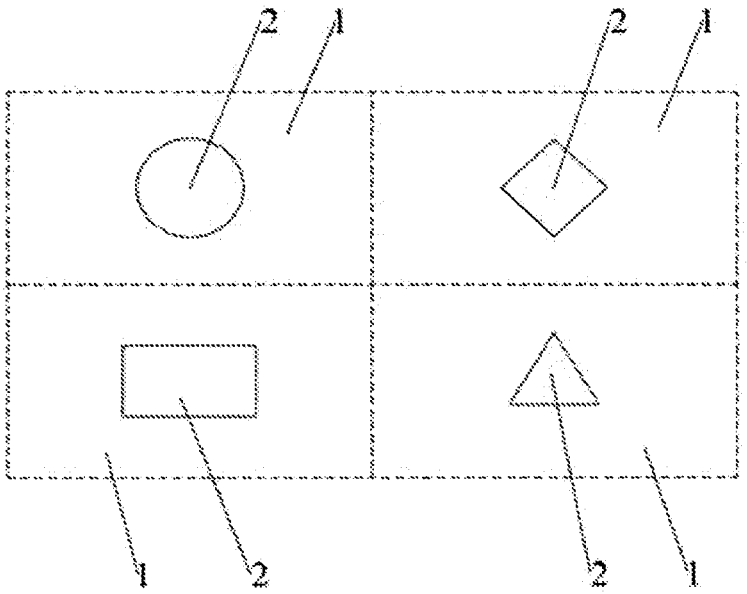
FIG. 8 is a schematic diagram showing the structure of adjacent soundproof units of the floor mat provided by Example 5.

Example 5: In this example, the cross-sectional shapes of the press hole along the depth direction may be different. As shown in FIG. 8, one soundproof structure 2 in adjacent soundproof units 1 may be arranged at the center of the soundproof unit 1. The soundproof structure 2 in the first soundproof unit 1 may be a circular hole, and the second soundproof structure 2 in the soundproof unit 1 may be a square hole. Similarly, the soundproof structures 2 in other soundproof units 1 may be rectangular holes, triangular holes, diamond holes, star holes or the like.

Example 6: In this example, the depths of the press hole may be different. one soundproof structure 2 may be provided in adjacent soundproof units 1, the soundproof structure 2 may be a press hole. The depth of the press hole in the first soundproof unit 1 may be $h_1$, the depth of the press hole in the second soundproof unit 1 may be $h_2$, and $h_1 \neq h_2$.

The above examples are only for further explaining the different shapes of the press holes, and the different shapes of the press holes in this embodiment are not limited to one of the above three forms. The different shapes of the press hole can also be: the diameter of the press hole and the cross-sectional shape of the press hole in the depth direction may be different; the hole diameter and the depth of the press hole may be different; the cross-sectional shape and the depth of the press hole may be different; the hole diameter, the depth of the hole and the cross-sectional shape of the hole in the depth direction may be all different.

In this embodiment, the soundproof structures 2 in adjacent soundproof units 1 only need to have the same number and distribution positions, and the specific number and specific distribution positions are not limited. For example, the number can be one, two or more; the distribution position can be that arranged at the center of the soundproof unit 1, close to the same side, close to the same vertex, and so on.

The Sixth Embodiment

This embodiment is an explanation of the difference in at least one of the number, shape, and distribution position of the soundproof structures 2 in the adjacent soundproof units 1 described in the first embodiment. In the floor mat provided in this embodiment, the soundproof structures 2 in adjacent soundproof units 1 have the same number, different shapes, and different distribution positions. The difference between this embodiment and the fifth embodiment lies in the different distribution positions. The following gives examples showing the structure of the floor mat of this embodiment.

Figure 9:
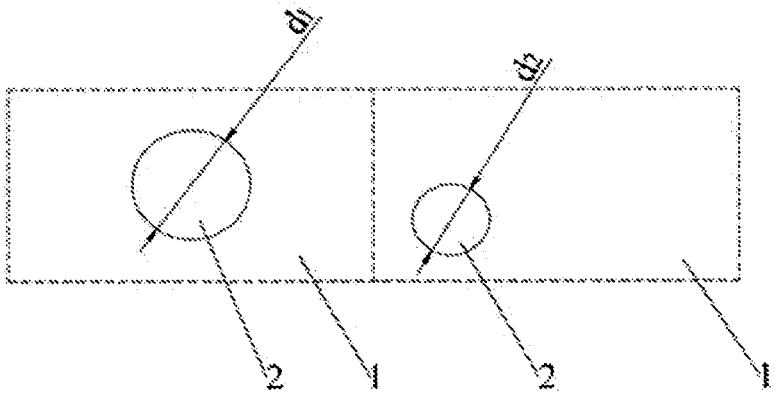
FIG. 9 is a schematic diagram showing the structure of adjacent soundproof units of the floor mat provided by Example 7.

Example 7: As shown in FIG. 9, one soundproof structure 2 in adjacent soundproof units 1 may be arranged at the center of soundproof unit 1. The soundproof structures 2 in adjacent soundproof units 1 may be all blind holes. The hole diameter of the blind hole in the first soundproof unit 1 may be $d_1$, the depth of the press hole in the second soundproof unit 1 may be $d_2$, and $d_1 \neq d_2$; the blind holes in the first soundproof unit 1 may be arranged at the center of the soundproof unit 1, the blind holes in the second soundproof unit 1 may be arranged at a position near the corner of the soundproof unit 1.

Figure 10:
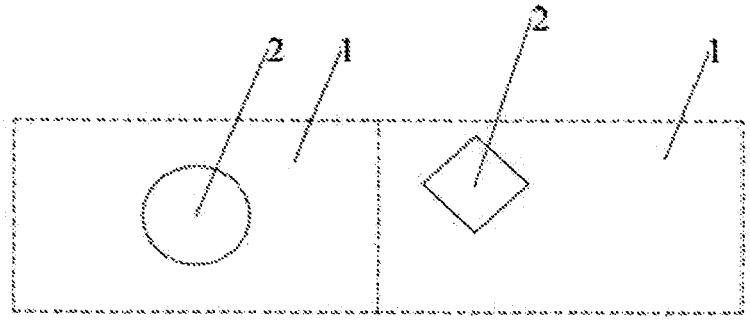
FIG. 10 is a schematic diagram showing the structure of adjacent soundproof units of the floor mat provided by Example 8.

Example 8: As shown in FIG. 10, one soundproof structure 2 may be provided in adjacent soundproof units 1. The soundproof structure 2 in the first soundproof unit 1 may be a circular hole and may be arranged at the center of the soundproof unit 1; the soundproof structure 2 in the second soundproof unit 1 may be a square hole and may be arranged at a position near the corner of the soundproof unit 1. Similarly, the soundproof structures 2 in other soundproof units 1 may be rectangular holes, triangular holes, diamond holes, star holes, and so on.

The Seventh Embodiment

This embodiment is an explanation of the difference in at least one of the number, shape, and distribution position of the soundproof structures 2 in the adjacent soundproof units 1 described in the first embodiment. In the floor mat provided in this embodiment, the number of soundproof structures 2 in adjacent soundproof units 1 may be different, the shapes may be the same, and the distribution positions may be different. The difference between this embodiment and the third embodiment lies in the number. The following is an example showing the structure of the floor mat of this embodiment.

Figure 11:
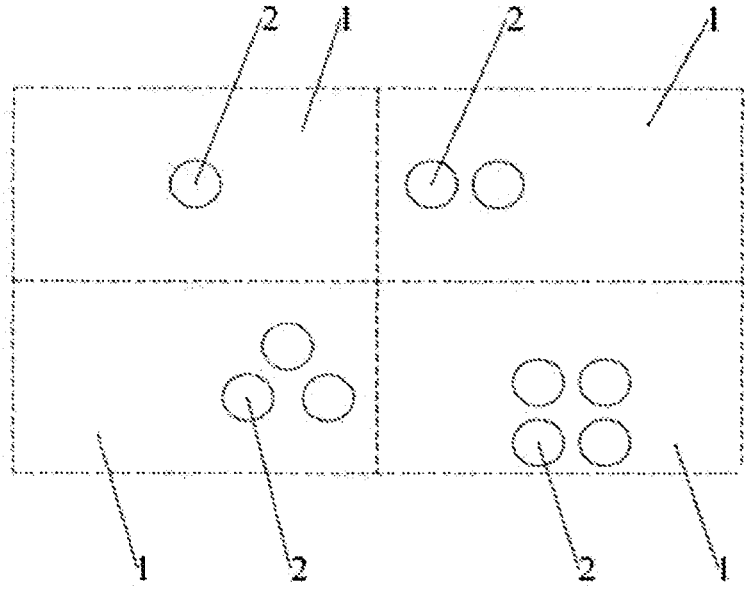
FIG. 11 is a schematic diagram showing the structure of adjacent soundproof units of the floor mat provided by Example 9.

Example 9: As shown in FIG. 11, among the four soundproof units 1 distributed in an array, the soundproof structures 2 may be all blind holes. One blind hole in the first soundproof unit 1 may be arranged at the center of the soundproof unit 1; two blind holes in the second soundproof unit 1 may be arranged near the left side of the soundproof unit 1; three blind holes in the third soundproof unit 1 may be arranged near the right side of the soundproof unit 1; four blind holes in the fourth soundproof unit 1 may be arranged near the lower side of the soundproof unit 1.

The Eighth Embodiment

This embodiment is an explanation of the difference in at least one of the number, shape, and distribution position of the soundproof structures 2 in the adjacent soundproof units 1 described in the first embodiment. In the floor mat provided in this embodiment, the number of soundproof structures 2 in adjacent soundproof units 1 may be different, the shapes may be different, and the distribution positions may be the same. The following is an example showing the structure of the floor mat of this embodiment.

Figure 12:
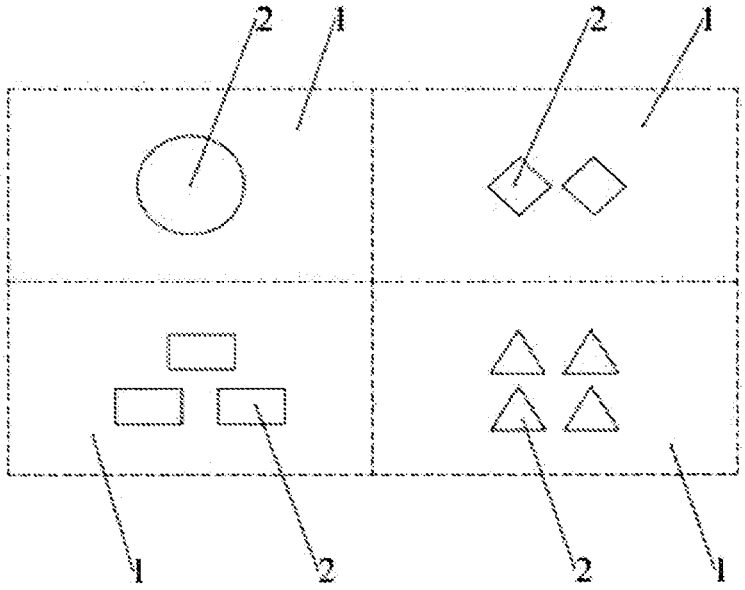
FIG. 12 is a schematic diagram showing the structure of adjacent soundproof units of the floor mat provided by Example 10.

Example 10: As shown in FIG. 12, among the four soundproof units 1 distributed in an array, the soundproof structure 2 in each soundproof unit 1 may be distributed at the center of the soundproof unit 1. Wherein the soundproof structure 2 may be a circular hole, the number of circular holes may be one; the soundproof structures 2 in the second soundproof unit 1 may be square holes, the number of square holes may be two; the soundproof structure 2 in the third soundproof unit 1 may be rectangular holes, the number of rectangular holes may be three; the soundproof structure 2 in the fourth soundproof unit 1 may be all triangular holes, and the number of triangular holes may be four.

The Ninth Embodiment

This embodiment is an explanation of the difference in at least one of the number, shape, and distribution position of the soundproof structures 2 in the adjacent soundproof units 1 described in the first embodiment. In the floor mat provided in this embodiment, the number, shape, and distribution positions of the soundproof structures 2 in adjacent soundproof units 1 may be different.

Figure 13:
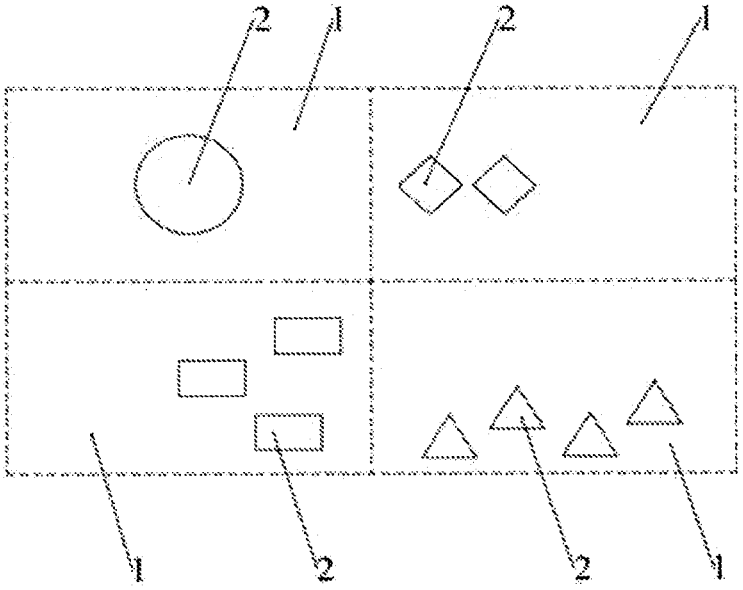
FIG. 13 is a schematic diagram showing the structure of adjacent soundproof units of the floor mat provided in Example 11.

Example 11: As shown in FIG. 13, among the four soundproof units 1 distributed in an array, the soundproof structure 2 in the first soundproof unit 1 may be a circular hole, and the number of circular holes may be one and located at the center of the soundproof unit 1; the soundproof structures 2 in the second soundproof unit 1 may be square holes, the number of square holes may be two and located near the left side of the soundproof unit 1; the soundproof structure 2 in the third soundproof unit 1 may be rectangular holes, the number of rectangular holes may be three and located near the right side of the soundproof unit 1; and the soundproof structures 2 in the fourth soundproof unit 1 may be all triangular holes, and the number of triangular holes may be four and located near the lower side in the soundproof unit 1.

The Tenth Embodiment

In this embodiment, the soundproof structure 2 may be a special-shaped recessed area or a special-shaped protrusion designed according to text or a pattern, and at least one of the size, shape, and distribution position of the special-shaped recessed area or the special-shaped protrusion in the adjacent soundproof unit 1 may be different. In the actual production and application of floor mats, the text can be customized according to the needs of different customers, and only the engraving structure of the roller needs to be customized during production. A soundproof cavity may be formed in the special-shaped recessed area, which effectively blocks sound.

The soundproof effect of the floor mat provided by the present disclosure is tested below.

The test conditions may be as follows:

Test method: GB/T 19889.3-2005

Test temperature: 25° C.

Relative humidity: 63%

Standard sample area: 10.5 $m^2$

Receiving room volume: 111 $m^3$

In the tests, the control group and the experimental group were tested for soundproof. The control group adopted ordinary floor mats, and the experimental group adopted the floor mats provided by the present disclosure. The thickness of the floor mats and the coverage area on the ground were the same for the control group and the experimental group. The experimental data may be shown in Table 1.

TABLE 1

| 1/3 frequency band center frequency/Hertz | Weighted soundproof (dB) | |
|---|---|---|
| | Experimental Group | Control Group |
| 100 | 75.1 | 59.7 |
| 125 | 76.7 | 60.2 |
| 160 | 78.3 | 61.4 |
| 200 | 80.5 | 63.7 |
| 250 | 71.3 | 62.8 |
| 315 | 75.5 | 62.9 |
| 400 | 78.5 | 63.5 |
| 500 | 80.6 | 68.3 |
| 630 | 81.4 | 68.9 |
| 800 | 83.9 | 70.1 |
| 1000 | 85.7 | 71.3 |
| 1250 | 85.9 | 71.6 |
| 1600 | 87.4 | 74.5 |
| 2000 | 89.9 | 74.7 |
| 2500 | 90.4 | 77.8 |
| 3150 | 90.7 | 78.2 |

From the above data analysis, it can be known that the floor mats provided by the present disclosure can isolate both high-frequency noise and low-frequency noise to a certain extent, and can effectively improve the soundproof effect of the room.

Obviously, the foregoing embodiments of the present disclosure are merely examples for the purpose of clearly illustrating the present disclosure, and are not intended to limit the embodiments of the present disclosure. For those of ordinary skill in the art, other changes or modifications in different forms can be made on the basis of the above description. There is no need and cannot give an exhaustive list of all implementation methods. Any modifications, equivalent replacements and improvements made within the spirit and principle of the present disclosure shall be included in the protection scope of the claims of the present disclosure.

What is claimed is:

1. A floor mat, wherein comprising a floor mat body made of foamed material; at least one surface of the floor mat body being formed with a number of soundproof units with same areas; each of the soundproof units being provided with at least one soundproof structure, and the soundproof structures in adjacent soundproof units being different in at least one of numbers, shapes and distribution positions, wherein the soundproof structures are blind holes, at least one of diameters of the blind holes, depths of the blind holes, and cross-sectional shapes of the blind holes in the depth direction are different; a bottom surface of each of the blind hole is provided with a scattering block that has a plurality of scattering surfaces and protrudes from the bottom surface of the respective blind hole.

2. The floor mat according to claim 1, wherein the plurality of the scattering surfaces of each scattering block form block portions at their intersections, and in all of the block portions of each scattering block, one of the block portions that is the farthest from a center layer of the floor mat forms a support portion for interacting with the ground, each support portion of two adjacent scattering blocks of said scattering blocks have a same distance to the center layer of the floor mat, and a distance from the support portion to the bottom surface of the respective blind hole is not greater than the depth of the respective blind hole.

3. The floor mat according to claim 1, wherein each soundproof unit is of a rectangular shape, with an area of 2 $cm^2$ to 100 $cm^2$.

4. The floor mat according to claim 1, wherein the foamed material is one or more selected from a group consisting of IXPE, EVA, XPE and foamed polyethylene.

5. A floor, wherein comprising a floor layer and a floor mat layer that have same plane sizes, the floor mat layer being composed of a floor mat according to any one of claims 1, 2, 3, and 4, and the floor mat layer being bonded to a back of the floor layer, the floor layer having a thickness 1-18 times a thickness of the floor mat layer.

6. A floor mat, wherein comprising a floor mat body made of foamed material, at least one surface of the floor mat body being formed with a number of soundproof units with a same area, and each of the soundproof units having at least one soundproof structure, and the soundproof structures in adjacent soundproof units being different in at least one of numbers, shapes and distribution positions; wherein each soundproof structure is a scattering block that has with a plurality of scattering surfaces and protrudes to one side of the floor mat body, the plurality of the scattering surfaces of each scattering block form block portions at their intersections, and in all of the block portions of each scattering block, one of the block portions that is the farthest from a center layer of the floor mat forms a support portion for interacting with the ground, each support portion of two adjacent scattering blocks of said scattering blocks have a same distance to the center layer of the floor mat.

7. The floor mat according to claim 6, wherein each soundproof unit is of rectangular shape, with an area of 2 $cm^2$ to 100 $cm^2$.

8. The floor mat according to claim 6, wherein the foamed material is one or more selected from a group consisting of DOE, EVA, XPE and foamed polyethylene.

9. A floor, wherein comprising a floor layer and a floor mat layer that have same plane sizes, the floor mat layer being composed of a floor mat according to any one of claims 6-8, and the floor mat layer being bonded to a back of the floor layer, the floor layer having a thickness 1-18 times a thickness of the floor mat layer.

* * * * *